US006622452B2

(12) United States Patent
Alvaro

(10) Patent No.: US 6,622,452 B2
(45) Date of Patent: Sep. 23, 2003

(54) INSULATED CONCRETE WALL CONSTRUCTION METHOD AND APPARATUS

(75) Inventor: Timothy Alvaro, Royal Oak, MI (US)

(73) Assignee: Energy Efficient Wall Systems, L.L.C., Auburn Hills, MI (US)

( * ) Notice: Subject to any disclaimer, the term of this patent is extended or adjusted under 35 U.S.C. 154(b) by 30 days.

(21) Appl. No.: 09/795,662

(22) Filed: Feb. 28, 2001

(65) Prior Publication Data

US 2001/0020351 A1 Sep. 13, 2001

Related U.S. Application Data

(63) Continuation-in-part of application No. 09/246,977, filed on Feb. 9, 1999, now abandoned.
(60) Provisional application No. 60/229,068, filed on Aug. 30, 2000.

(51) Int. Cl.[7] ..... E04G 23/00
(52) U.S. Cl. ..... 52/747.14; 52/309.7; 52/309.9; 52/309.11; 52/309.12; 52/309.17; 52/309.16; 52/309.15; 52/481.1; 52/292; 52/293.3; 52/294
(58) Field of Search ..... 52/309.7, 309.8, 52/309.9, 309.11, 309.12, 309.17, 309.16, 309.15, 425, 481.1, 292, 293.3, 294; 264/31, 228

(56) References Cited

U.S. PATENT DOCUMENTS

| | | | |
|---|---|---|---|
| 1,616,977 | A | 2/1927 | Koivu |
| 3,145,505 | A | 8/1964 | Cornelius |
| 3,562,970 | A | 2/1971 | Schwartz |
| 3,778,020 | A | 12/1973 | Burrows et al. |
| 3,788,020 | A | 1/1974 | Gregori |
| 3,835,608 | A | 9/1974 | Johnson |
| 3,872,636 | A | 3/1975 | Nicosia |
| 4,033,544 | A | 7/1977 | Johnston |
| 4,047,355 | A | 9/1977 | Knorr |

(List continued on next page.)

OTHER PUBLICATIONS (1) TF Insulated Concrete Building System, TF System Insulated Concrete Walls: Revolutionizing the Building Industry from the Ground Up.
(2) TF System Construction Details, Rev. Nov. 1999.
(3) Application filed on or about Feb. 12, 2001, Ser. No. unknown, filed on behalf of Gary Hendrickson, Timothy Alvaro, Brian Edward Koehn and David Levy entitled Insulated Concrete Wall Construction Method and Apparatus.
(4) Affidavit of Thomas Alvaro, undated.
(5) Drawing labeled New Energy Wall System dated Jun. 1, 1997 showing a prior art wall construction method.

*Primary Examiner*—Carl D. Friedman
*Assistant Examiner*—Steve M Varner
(74) *Attorney, Agent, or Firm*—Carlson, Gaskey & Olds

(57) ABSTRACT

An insulated concrete form panel assembly for constructing insulated concrete walls includes a frame comprising a plurality of steel studs and at least two cross members that connect the studs together. A pair of insulating panels are fastened to and span respective inner and outer opposing sides of the frame so as to define concrete receiving cavities between the panels and the studs. A brick ledge may be constructed by separating a laterally extending, generally rectangular elongated mid portion of the outer insulating panel from a remainder of the outer insulating panel. An upper edge of the mid portion is then moved a predetermined distance outward from the remainder of the outer insulating panel such that the mid portion is disposed in a desired position at an angle to the remainder of the outer insulating panel. The mid portion is then secured in the desired position relative to the frame.

4 Claims, 4 Drawing Sheets

U.S. PATENT DOCUMENTS 4,177,968 A * 12/1979 Chapman ..... 249/211
4,223,501 A 9/1980 DeLozier
4,314,431 A 2/1982 Rabassa
4,433,520 A 2/1984 Maschhoff
4,516,372 A 5/1985 Grutsch
4,532,745 A 8/1985 Kinard
4,590,729 A 5/1986 Hegazi
4,625,484 A 12/1986 Oboler
4,669,240 A 6/1987 Amormino
4,832,308 A 5/1989 Slonimsky et al.
4,869,037 A 9/1989 Murphy
4,888,931 A 12/1989 Meilleur
4,967,528 A 11/1990 Doran
5,140,794 A 8/1992 Miller
5,216,863 A 6/1993 Nessa et al.
5,323,578 A 6/1994 Chagnon et al.
5,371,990 A 12/1994 SalahUddin
5,471,806 A 12/1995 Rokhlin
5,488,806 A 2/1996 Melnick et al.
5,491,947 A 2/1996 Kim
5,522,194 A * 6/1996 Graulich ..... 52/309.4
5,526,625 A 6/1996 Emblin et al.
5,540,020 A 7/1996 Santini
5,566,521 A 10/1996 Andrews et al.
5,570,552 A 11/1996 Nehring
5,617,686 A 4/1997 Gallagher, Jr.
5,657,600 A 8/1997 Mensen
5,697,196 A 12/1997 SalahUddin
5,704,180 A 1/1998 Boeck
5,724,782 A 3/1998 Rice et al.
5,729,942 A 3/1998 Moore, Jr.
5,749,196 A 5/1998 Bangma
5,759,849 A 6/1998 Aoyagi et al.
5,771,648 A 6/1998 Miller et al.
5,771,654 A 6/1998 Moore et al.
5,809,725 A 9/1998 Cretti
5,839,243 A 11/1998 Martin
5,839,249 A 11/1998 Roberts
5,852,907 A 12/1998 Tobin et al.
5,887,401 A 3/1999 Moore, Jr.
6,041,561 A * 3/2000 LeBlang ..... 52/234
6,076,323 A * 6/2000 Chiu ..... 52/239
6,085,476 A 7/2000 Jantzi et al.
6,247,280 B1 6/2001 Grinshpun et al.
6,263,628 B1 7/2001 Griffin
6,276,104 B1 8/2001 Long, Sr. et al.
6,351,918 B1 3/2002 Westra et al.
6,363,683 B1 4/2002 Moore, Jr.
6,401,413 B1 6/2002 Niemann
6,401,417 B1 6/2002 Leblang
6,438,923 B2 8/2002 Miller

* cited by examiner

INSULATED CONCRETE WALL CONSTRUCTION METHOD AND APPARATUS

This application claims priority to provisional application U.S. Serial No. 60/229,068 and is a Continuation-in-Part of U.S. patent application Ser. No. 09/246,977, filed Feb. 9, 1999.

TECHNICAL FIELD

This invention relates to insulating concrete from (ICF) systems for constructing walls.

INVENTION BACKGROUND

Insulating Concrete Form (ICF) systems are known for use in constructing exterior wall systems with high performance and environmentally friendly materials that have vastly improved the energy efficiency, air quality, durability and overall comfort of dwelling structures. The relatively high cost of constructing and using these forms, however, have limited their acceptance to the upper spectrum of the customer home market.

One example of such a system is disclosed in U.S. Pat. No. 4,223,501 issued Sep. 23, 1980 to DeLozier (the DeLozier patent). The DeLozier patent discloses an insulated concrete wall form comprising a plurality of blocks arranged in stacked courses. Each block includes a pair in insulating panels in a spaced parallel disposition. The panels of each block are held together by vertically oriented steel panels. However, stacked courses of blocks are time-consuming to construct.

Another known type of insulated concrete form system is disclosed in U.S. Pat. No. 5,809,725 issued Sep. 22, 1998 to Cretti (the Cretti patent). The Cretti patent discloses an insulated concrete wall panel form that includes a framework of interconnected wires holding two insulating panels in a spaced parallel disposition. Similarly, U.S. Pat. No. 5,852,907 issued Dec. 29, 1998 to Tobin et al., disclosed an insulated concrete wall panel form design that includes a framework of steel reinforcing rods and form ties that interlock parallel form panels. However, the interconnecting wires and rods are difficult and time consuming to assemble with insulating panels.

U.S. Pat. No. 5,839,249 issued Nov. 24, 1998 to Roberts (the Roberts patent) disclosed vertically oriented interconnected steel studs that extend vertically through vertically oriented openings in stacked foam concrete form blocks in an insulated concrete wall panel structure. These vertically oriented studs are used to help vertically align the stack of foam blocks and are inserted through cylindrical cavities that are alternated with other cylindrical cavities into which concrete is poured.

Both U.S. Pat. Nos. 4,033,544 and 6,085,476 disclose fabricating insulated concrete wall panel forms, transporting those frames to a work site, and connecting the panels together pouring concrete into them.

What is needed is a simpler and quicker way to assemble insulating concrete wall forms at a job site.

INVENTION SUMMARY

An insulated concrete form panel assembly is provided that includes a frame comprising a plurality of steel studs and at least two cross members that connect the studs together. A pair of insulating panels are fastened to and span respective inner and outer opposing sides of the frame so as to define concrete receiving cavities between the panels and the studs.

A method of forming insulated concrete walls is provided that includes the steps of providing a plurality of steel studs and inner and outer insulating panels. A frame is formed by connecting a cross member between the steel studs. An insulated concrete form panel is then completed by attaching the inner and outer insulating panels to respective opposite inner and outer sides of the frame such that the panels generally span the inner and outer sides of the frame.

According to another aspect of the invention the formation of the insulated concrete form panel may also include configuring the insulated concrete from panel to form a brick ledge when concrete is provided within the panel. Configuring the insulated concrete form panel to form a brick ledge includes at least partially separating a laterally extending, generally rectangular elongated mid portion of the outer insulating panel from a remainder of the outer insulating panel. An upper edge of the mid portion is then moved a predetermined distance outward from the remainder of the outer insulating panel such that the mid portion is disposed in a desired position at an angle to the remainder of the outer insulating panel. The mid portion is then secured in the desired position relative to the frame.

This method and apparatus reduces labor costs and construction time, and can be installed at a cost low enough to serve the middle marker and affordable market.

Figure 1:
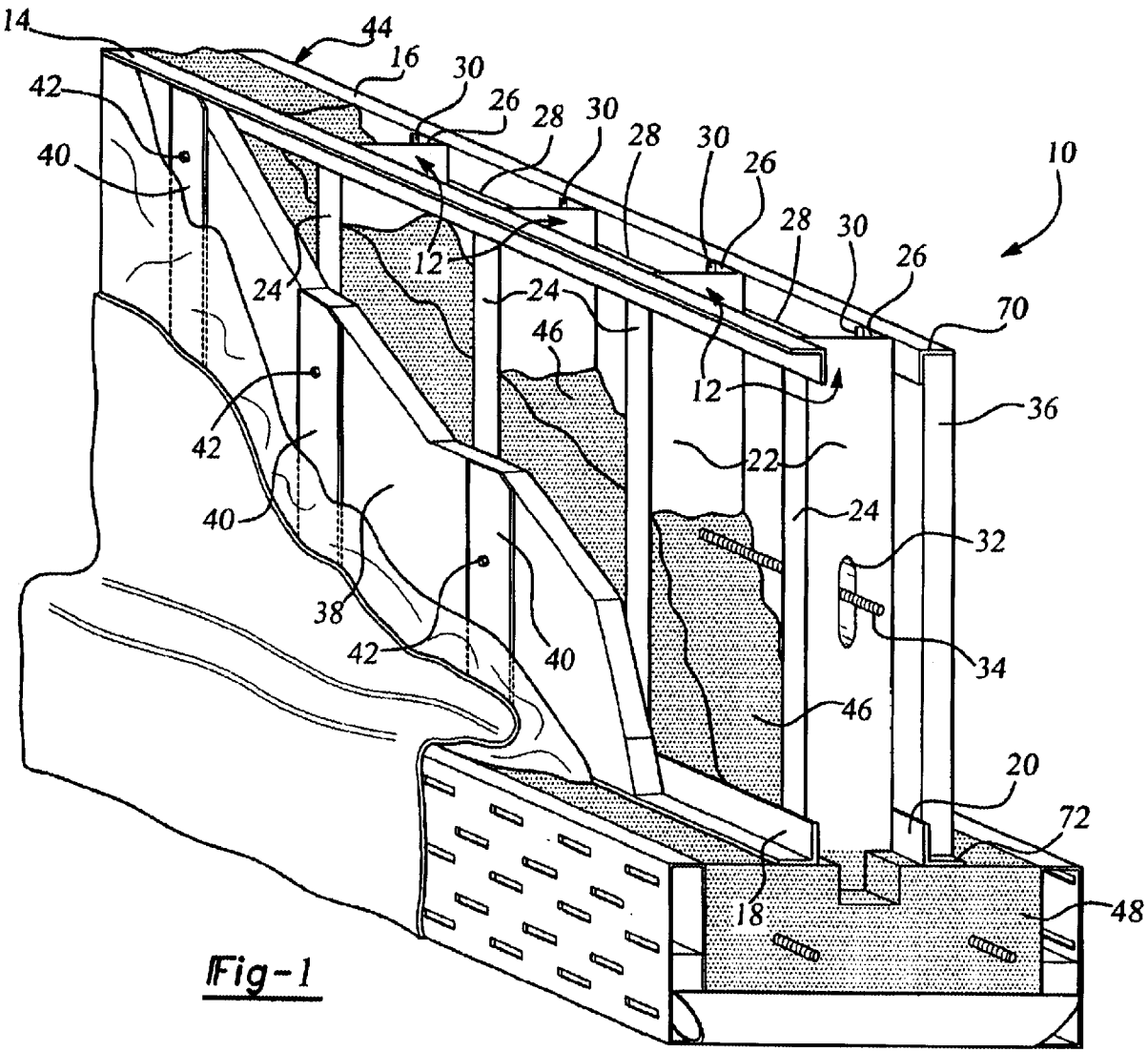
FIG. 1 is a respective cutaway view of au insulated wall panel constructed according the invention and partially filed with concrete.

I intend this description to illustrate certain embodiments of the invention rather than to limit the invention. Therefore I have used descriptive words rather that limiting words. Obviously, it's possible to modify this invention from what the description teaches. One may practice the invention other than as described.

DETAILED DESCRIPTION

An insulated concrete 46 wall construction assembly constructed according to the invention is shown at 10 in the drawings. The assembly 10 includes a series of 18 gauge steel studs 12 oriented vertically and parallel to one another spaced approximately 10 inches apart on center. The studs 12 are held in place relative to one another by 20 gauge steel angle strip cross members 14, 16, 18, 20 to form a frame or framework 21. Two top angle strips 40 14, 16 are fastened across the studs 12 at opposite sides of upper ends of the studs 12 and two bottom angle strips 40 18, 20 are fastened across the studs 12 at opposite side of respective bottom ends of the studs 12.

Figure 2:
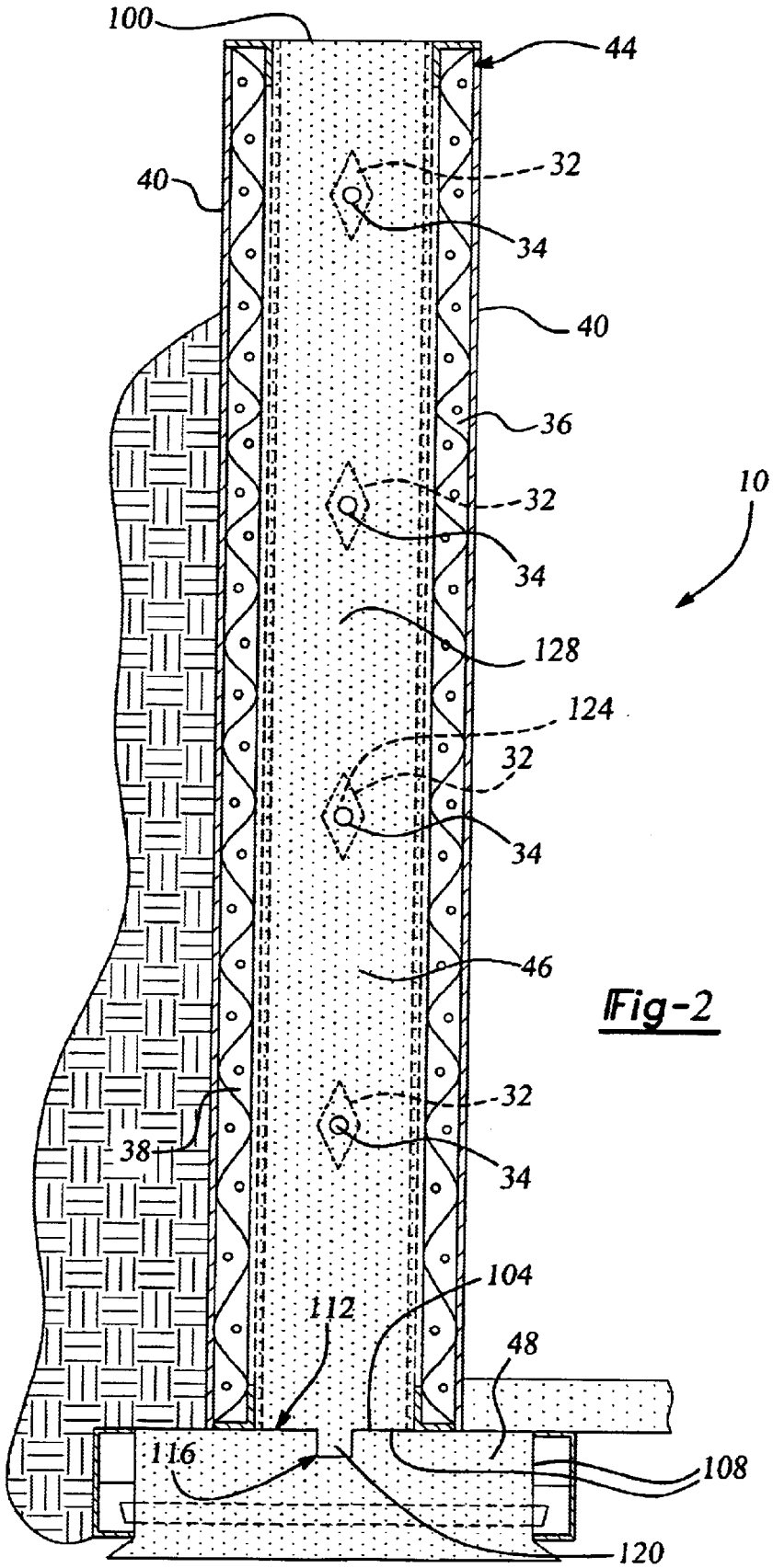
FIG. 2 is a cross-sectional side view of an insulated wall panel constructed according to the invention.

The studs 12 are standard construction well known in the art and are formed from rolled steel. As best shown in FIG. 2, each stud 12 has a c-shaped cross-section and is formed to include an elongated main panel 22 and a pair of opposing flanges 24, 26 that extend integrally and perpendicularly from along the length of the main panel 22 and provide stiffness to the studs. Inwardly directed elongated lips 28, 30 extend perpendicularly and integrally inward from along outer edges of each of the flanges 24, 26. The main panels 36, 38 22 of the studs 12 are in a facing relationship to one another, i.e., studs 12 are aligned such that side surfaces of the main panels 36, 38 22 face one another. The studs 12 may be of whatever length is necessary for a given wall application.

Each stud 12 also includes a plurality of apertures 32 typically spaced two feet apart on center along the length of each stud 12. The apertures 32 of each adjacent stud 12 line up horizontally to accommodate the passage of a horizontal steel reinforcing rod 34 and concrete 46 to form concrete reinforcing member 124. A length of grade 60⅜inch steel reinforcing rod 34 extends horizontally through each set of corresponding apertures 32 in the adjacent studs 12.

An inner sheet or panel 36 of commercially available insulating foam is fastened to a front or inner side of the framework 21 of steel studs 12 and a corresponding outer sheet or panel 38 of insulating foam is fastened to an opposite back or outer side of the framework 21 such that the two sheets 36, 38 of insulating foam are disposed parallel to one another. Each sheet of foam is preferably two-inch thick sheet of extruded polystyrene. Sheets of extruded polystyrene are readily available from a number of sources such as the Dow Chemical Company. The panel 36 could also be plywood, PVC foam plastic, oriented strand board, or other suitable material.

As best shown in FIG. 1, the foam panels 36, 38 are secured to opposites of the framework 21 using approximately two inch wide furring strips 40 and a plurality of fasteners 42 such as approximately three inch long deck screws. Deck screws are then preferred fasteners 42 as they are readily available in large quantities and easy to install using standard self-loading power drill. The screw fasteners 42 are spaced approximately ten inches on center along each furring strip 40 and the furring strips 40 are oriented vertically against outer surfaces of each of the insulating foam panels 36, 38 in alignment with side surfaces of each of the studs in the framework 21. The fasteners 42 pass through furring strips 40, the insulated foam panels 36, 38 and then into flanges 26, 28 at the sides of the studs 12. As such, the furring strips 40 distribute the loading of the fasteners 42 along vertical portions of the foam panels 36, 38 sandwiching the foam panels 36, 38 between the furring strips 40 and the flange portions 26, 28 of the studs 12.

The steel stud framework 21, foam panels 36, 38, furring strips 40, and associated fasteners 42 make up an insulating concrete form panel (ICFP) 44 and a form that can be transported to a building site fastened together with other insulating concrete form panels 36, 38 interlaced with steel reinforcing rod 34 and filled with concrete 46 as will be described below. Each ICFP 44 is configured to rest upon a standard poured concrete footing 48 having exterior surface 108 and swaddling the 2×3 keyway 120 at interface 112 that is formed into and runs along the centerline 116 of a standard concrete 46 footing 48.

Figure 3:
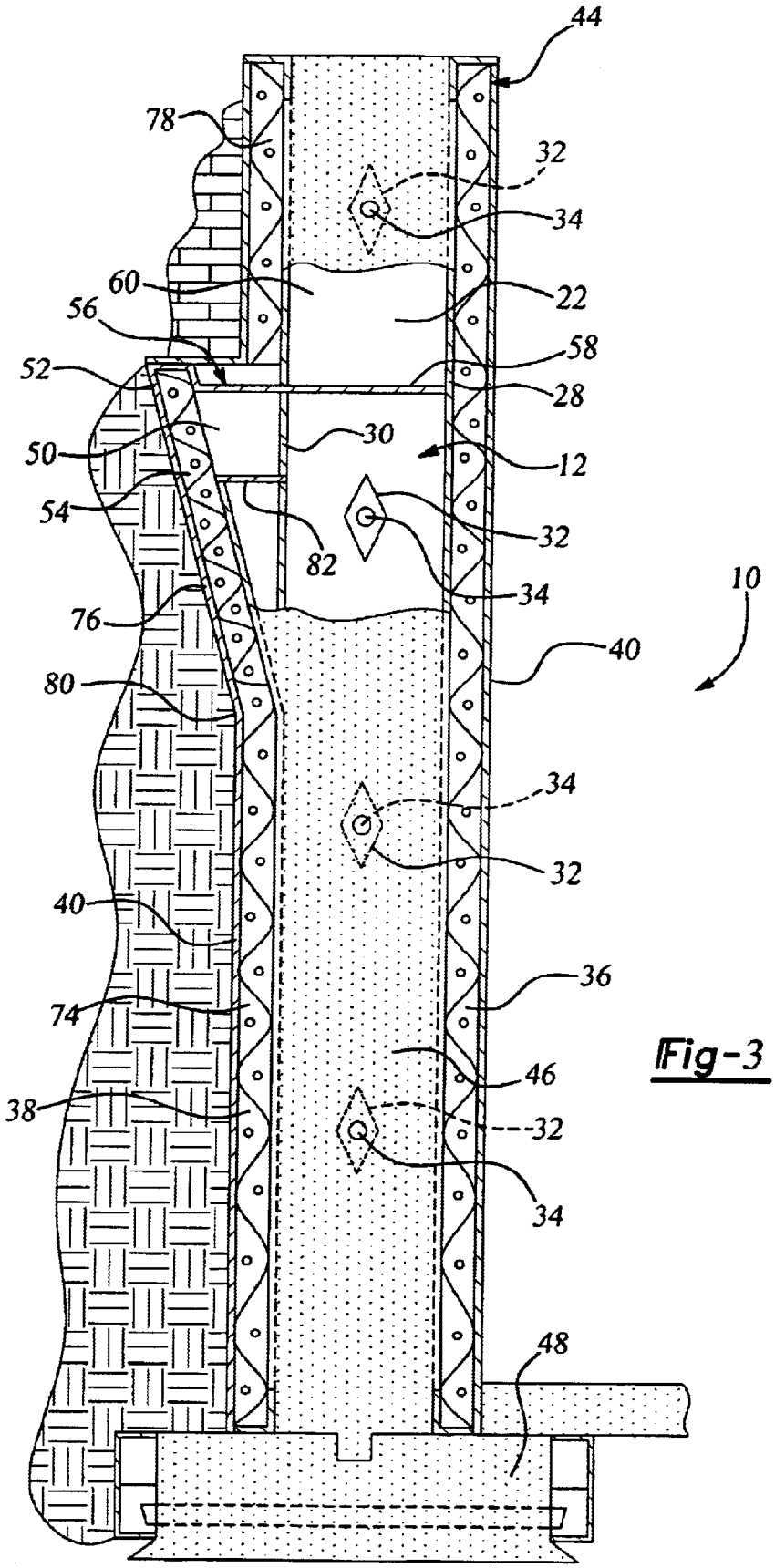
FIG. 3 is a partially cut-away cross-sectional side view of an insulated wall panel constructed according to the invention and including a brick ledge for supporting finishing materials such as brick or stone above ground level.
Figure 5:
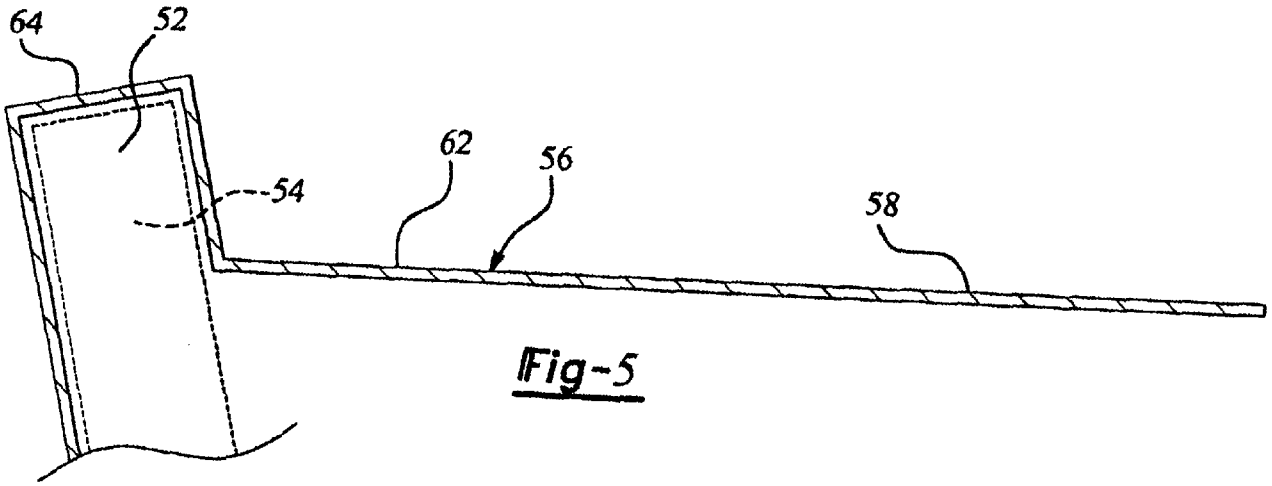
FIG. 5 is a side view of brick ledge tie of FIG. 4.
Figure 4:
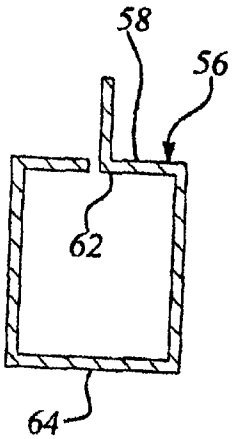
FIG. 4 is a front view of a brick ledge tie shown in FIG. 3.

As shown in FIG. 3, a brick ledge 50 can be formed to extend laterally from the outer surface of an ICFP 44. The brick ledge 50 is approximately two feet high and angles outward and upward at an approximate 15-degree angle such that a top edge 52 of an outwardly extended portion 54 of the outer panel 38 is spaced approximately 4½ from the outer surface of the outer foam panel 38. The outwardly angled portion 54 of the foam panel is held in place by a plurality of brick ledge ties 56 as shown in FIGS 4–6.

Figure 6:
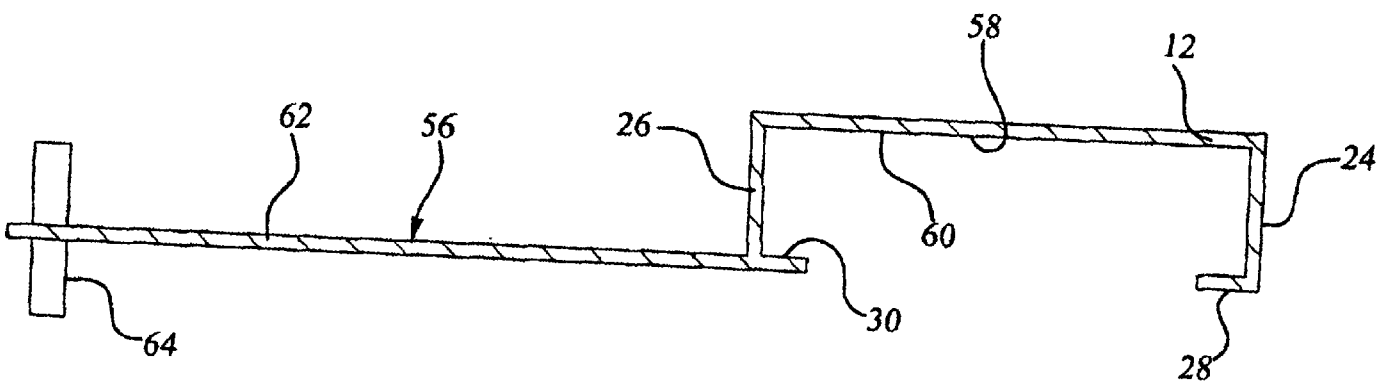
FIG. 6 is a top view of a brick ledge tie of FIG. 4.

Each brick ledge tie 56 is formed from a length of number nine gauge steel wire and is bent to include generally U-shaped anchor portion 58 shaped to form an interference with a stud 12 when oriented horizontally within an interior surface 60 of a stud 12 between the inner and outer flanges 24, 26 of the stud 12 as shown in FIGS. 3 and 6. As shown in FIGS. 5 and 6, an arm portion 62 of each brick ledge tie 56 extends from the anchor portion 58 horizontally to the top outer edge of 52 of the outwardly angles portion 54 of the outer insulator panel 38.

Each brick ledge tie 56 also includes a retainer portion 64 that extends from an outer end of the arm portion 62 and is configured to grasp the upper edge 52 of the outwardly angles foam panel portion 54. The retainer portion 64, as best shown in FIG. 4, is bent into a generally square shape to help distribute loads exerted by the brick ledge tie 56 on the upper edge 52 of the outwardly angled foam panel portion 54 once concrete 46 has been introduced into the ICFP 44. As shown in FIG. 5, the retainer portion 64 of the brick ledge tie 56 is angled to match the orientation of the outwardly angles portion 54 of the outer foam panel 38. As shown in FIG. 6, the retainer portion 64 of the brick ledge tie 56 is shaped to closely match the contours of the inner wall 60 of the steel stud 12. As best shown in FIG. 6, the retainer portion 64 is also shaped to bend or wrap around the outer lip 30 extending from the outer flange 26 of a stud 12 and then to merge into the arm position 62 and extend laterally outward in the general direction of the top edge 52 of the outwardly angled foam panel section 54.

In practice, insulated concrete 46 wall 128 having top surface 100 and bottom surface 104 can be constructed according to the present invention by first constructing the framework 21 of steel studs 12. The framework 21 is constructed by first inserting a pair of the angle strips 14, 18 into parallel spaced-apart slots formed in the flat topped surface of a table. The slots are formed into the table so that the angle strips 14, 18 are held in parallel spaced-apart orientation at a distance generally equal to a desired height of the wall to be constructed. The studs 12 are then laid parallel to one another such that the extend horizontally across the two angle strips 14, 18 with downward-facing ones of their flanges 24 resting on top of the two angle strips 14, 18. The studs are then attached to the angle strips 14, 18 using sheet metal screws driven through the downward-facing flange portion 24 of each stud 12 and into the angle strips 14, 18.

The remaining two angle strips 16, 20 are then placed on the upward-facing flange portions 26 of the studs 12 opposite the two angle strips 14, 18 that have already been fastened to the studs 12. The remaining angle strips 16, 20 are then fastened to the studs 12 in a like manner.

A foam panel 36 having a length and a width generally matching the corresponding length and width of the now completed framework 21 of steel studs 12, is then placed on the framework 21. The panel 36 is oriented such that upper and lower edges of the foam panel are retained by upwardly extending portions 70, 72 of each of the most recently fastened angle strips 16, 20. Furring strips 40 are then placed on the foam panel 36 in alignment with each of the steel studs 12 and are fastened in place as described above. The entire partially-completed panel is then flipped over and a second foam panel 38 of generally like dimensions is similarly affixed to the newly upturned side of the framework 21.

If a brick ledge such as the brick ledge shown at 50 in FIG. 3, is to be formed in the panel, when the outer foam panel 38 is laid down it is laid down in three separate horizontally oriented pieces 74, 76, 78. The three pieces are cut so as to completely cover the exposed outer side of the framework 21. A middle or mid section 76 of the three sections is cut two feet in vertical width and has a horizontal length that generally extends a full width of the ICFP. The middle section 76 will eventually serve as an angled outer insulating wall 76 of a brick ledge 50. To leave the middle section 76 free to rotate outward at a later point during wall construction, the furring strips 40 are cut and attached to leave the two foot wide horizontal section of wall exposed. After the furring strips 40 are attached as described above, and additional furring strip 80 is fastened along a bottom edge of the two-foot wide section, perpendicular to the other furring strip 40. In addition, at horizontally-spaced points approximately vertically midway along the center portion of the foam panel, roofing screws 82 are driven through the foam and into the steel studs 12 beneath to secure the middle foam panel section during transport.

The now completed ICFPs 44 have then transported in this foam to a job site by loading them onto a truck or other suitable conveyance. In the case of ICFPs 44 having a brick ledge 50*s*, the two-inch wide foam panel section 54 preferably remain secured until the ICFPS 44 have been unloaded at the job site and erected.

At the job site, each of the ICFPs 44 is placed on a standard footing 48 swaddling a standard three inch wide by two inch deep keyway 120 that is generally formed along the approximate centerline 116 of a concrete 46 footing 48 as shown in FIGS. 1–3. A lower end of each ICFP 44 is open to allow concrete 46 poured in a top end of each ICFP 44 to flow into the keyway 120 and lock the ICFPs 44 in position relative to the footing 48.

As each successive ICFP 44 is put into place, lengths of steel reinforcing rod 34 are inserted through the apertures 32 in the steel studs such that the reinforcing rod 34*s* are disposed horizontally to one another and perpendicular to the studs 12. Adjacent panels 36, 38 are fastened together edge-to-edge with short lengths of furring strips 40 that are screwed into the existing vertical furring strips 40 of the adjacent ICFPs 44.

At this point, any ICFPs 44 that are configured to form brick ledges 50 are set up for this purpose. To set up an ICFP to from a brick ledge 50, the roofing screws 82 securing the mid panel section 54 are backed out until mid panel section 54 forms an approximate 15 degree with remainder of the outer surface of the outer foam panel 38. At this point, the brick ledge ties 56 are installed by inserting the anchor portions 58 of each brick ledge tie 56 into one of the interior contours formed by the flanges 24, 26 and lips 28, 30 of each of the steel studs 12. The retainer portions 64 of each of the brick ledge ties 56 are then slipped over the top edge 52 of the mid panel section 54.

At this point, any gaps in or between the foam panel sections are filled with expanding foam adhesive. Concrete 46 is then pumped into cavities formed between the studs 12 and the foam panels 36, 38. In panels 36, 38 prepared to form brick ledges 50, the concrete 46 also flows outward against the outwardly angled foam panel portions to form a brick ledge 50. Standard methods for insuring there are no voids in the concrete 46 are then employed to include the use of a vibrator submerged into the concrete 46.

Constructed in this manner, the brick ledge 50 provides a high degree of sheer force resistance to vertical loads placed on the brick ledge 50. The approximate two foot vertical height of the brick ledge 50 and the shallow 15-degree outward angle provides at two foot high concrete cross-section that supports the brick ledge 50 against downwardly-applied vertical sheer forces. This construction obviates the need to suspend steel reinforcing rod 34*s* within the brick ledge 50 structure and also eliminates the time intensive task of installing such reinforcing rods.

Once the ICFPs 44 have been erected and joined to one another, a water proofing membrane is sprayed on the outer surface of the ICFPs 44 and along the interface or joint between the ICFPs 44 and the footing 48. The waterproofing membrane may be any one of a number of suitable such materials as are well known in the art and may be applied by any one of a number of known suitable means. A drain mat is preferably affixed over the membrane to protect the membrane from damage that can be caused by backfilling.

I intend the above description to illustrate embodiments of the present invention by using descriptive rather than limiting words. Obviously, there are many ways that one might modify these embodiments while remaining within the scope of the claims. In other words, there are many other ways that one may practice the present invention without exceeding the scope of the claims.

I claim:

1. An insulated concrete form panel assembly including:

a fram comprising a plurality of studs and at least one cross member that connects the studs together; and a pair of insulating panels fastened to and spanning respective inner and outer opposing sides of the frame so as to define concrete receiving cavities between the panels and the studs in which the fastening strips are oriented vertically against the panels in alignment with the studs.

2. An insulated concrete form panel assembly including:

a frame comprising a plurality of studs and at least one cross member that connects the studs together; and a pair of insulating panels fastened to and spanning respective inner and outer opposing sides of the frame so as to define concrete receiving cavities between the panels and the studs in which a mid-portion of the outside panel is configured to angle outward and upward from the rest of the outside panel to form an outer insulating wall of a brick ledge and in which a plurality of brick ledge ties secure the outwardly angled portion of the foam panel to the studs.

3. The assembly of claim 2 in which each brick ledge tie is bent to include a generally U-shaped anchor portion shaped to form an interference fit when oriented horizontally within interior contours defined by the main panel, flanges and the lips of a stud.

4. The assembly of claim 1 in which each brick ledge tie includes:

an arm position that extends from the anchor portion horizontal to the top outer edge of the outwardly angled portion; and a retainer portion that extends from an outer end of the arm and is configured to grasp the upper edge of the outwardly angled foam panel portion.

* * * * *

UNITED STATES PATENT AND TRADEMARK OFFICE

CERTIFICATE OF CORRECTION

PATENT NO. : 6,622,452 B2
DATED : September 23, 2003
INVENTOR(S) : Timothy Alvaro It is certified that error appears in the above-identified patent and that said Letters Patent is hereby corrected as shown below:

Column 6,
Line 27, “fram” should be -- frame --
Line 57, “horizontal” should be -- horizontally --

Signed and Sealed this

Second Day of December, 2003

JAMES E. ROGAN
*Director of the United States Patent and Trademark Office*